US009153164B2

(12) United States Patent
Lee

(10) Patent No.: US 9,153,164 B2
(45) Date of Patent: Oct. 6, 2015

(54) ORGANIC LIGHT EMITTING DISPLAY FOR ADJUSTING DATA BASED ON TEMPERATURE COMPENSATION AND DRIVING METHOD THEREOF

(71) Applicant: Jae-Hoon Lee, Yongin (KR)

(72) Inventor: Jae-Hoon Lee, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 132 days.

(21) Appl. No.: 13/916,866

(22) Filed: Jun. 13, 2013

(65) Prior Publication Data

US 2014/0168280 A1 Jun. 19, 2014

(30) Foreign Application Priority Data

Dec. 18, 2012 (KR) ..... 10-2012-0148226

(51) Int. Cl.
*G09G 3/30* (2006.01)
*G09G 3/32* (2006.01)

(52) U.S. Cl.
CPC ..... *G09G 3/3208* (2013.01); *G09G 2320/0233* (2013.01); *G09G 2320/041* (2013.01)

(58) Field of Classification Search
CPC ..... G09G 2320/041; G09G 2320/0666
USPC ..... 345/78
See application file for complete search history.

(56) References Cited

U.S. PATENT DOCUMENTS

| | | | | |
|---|---|---|---|---|
| 2009/0079727 | A1* | 3/2009 | Ozawa | 345/214 |
| 2009/0184901 | A1* | 7/2009 | Kwon | 345/77 |
| 2010/0045709 | A1* | 2/2010 | Nakamura et al. | 345/690 |
| 2014/0104259 | A1* | 4/2014 | Oh et al. | 345/212 |

FOREIGN PATENT DOCUMENTS

| | | | |
|---|---|---|---|
| KR | 102-007-0076927 | A | 7/2007 |
| KR | 10-2011-0067356 | A | 6/2011 |

* cited by examiner

*Primary Examiner* — Long D Pham
(74) *Attorney, Agent, or Firm* — Lee & Morse, P.C.

(57) ABSTRACT

A driving method of an organic light emitting display device includes sensing temperatures of a plurality of areas included in a pixel unit and, when a temperature difference between the respective areas is less than a predetermined reference value, outputting first data that is input from outside. When the temperature difference between the respective areas is equal to or greater than the reference value, the method includes generating second data by changing a grayscale of the first data such that the temperatures of the respective areas are similar to each other, and outputting the second data.

18 Claims, 8 Drawing Sheets

ORGANIC LIGHT EMITTING DISPLAY FOR ADJUSTING DATA BASED ON TEMPERATURE COMPENSATION AND DRIVING METHOD THEREOF

CROSS-REFERENCE TO RELATED APPLICATION

This application claims priority to and the benefit of Korean Patent Application No. 10-2012-0148226, filed on Dec. 18, 2012, in the Korean Intellectual Property Office, and entitled: "ORGANIC LIGHT EMITTING DISPLAY DEVICE AND DRIVING METHOD THEREOF," the entire content of which is incorporated herein by reference.

BACKGROUND

1. Field

Embodiments relate to an organic light emitting display device and a driving method thereof.

2. Description of the Related Art

It may be desirable for flat panel display devices to reduce weight and volume, which may be considered disadvantages of a cathode ray tube. As the flat panel display device, there are, e.g., a liquid crystal display, a field emission display, a plasma display panel, an organic light emitting display device, and the like. Among the flat panel display devices, the organic light emitting display device, which displays an image using an organic light emitting diode generating light by recombination of electrons and holes, may have a fast response speed and may be driven at a low power.

SUMMARY

Embodiments are directed to a driving method of an organic light emitting display device includes sensing temperatures of a plurality of areas included in a pixel unit, and when a temperature difference between the respective areas is less than a predetermined reference value, outputting first data that is input from outside. The method also includes, when the temperature difference between the respective areas is equal to or greater than the reference value, generating second data by changing a grayscale of the first data such that the temperatures of the respective areas are similar to each other, and outputting the second data.

The area may include at least one pixel. The sensing of the temperature may include inputting the first data, extracting a current flowing in each area using the first data, and calculating the temperature of each area by using the extracted current, a process deviation, and a resistance value of each area. In the sensing of the temperatures, the temperatures of each area may be sensed using temperature sensors installed in each area. A grayscale of the second data may be set to be different from that of the first data by a predetermined threshold value. A grayscale value of the second data may be set so as to be slowly changed from a grayscale higher or lower than the grayscale of the first data by the threshold value to the grayscale of the first data. The grayscale of the second data may be set to be slowly changed from the grayscale of the first data to the grayscale higher or lower by the threshold value or be slowly changed from the grayscale higher or lower by the threshold value to the grayscale of the first data. The second data may maintain the grayscale higher or lower by the threshold value during at lease one frame period. In the case in which the first data supplied to a specific pixel are changed into the second data, a light-emitting time of the specific pixel may be changed within the one frame period.

Embodiments are also directed to an organic light emitting diode display including a pixel unit including pixels at portions at which scan lines and data lines intersect with each other, and a temperature compensation unit, the temperature compensation unit outputting first data or second data according to temperatures of a plurality of areas included in the pixel unit, the first data being input from outside, and the second data being generated by changing a grayscale of the first data.

The temperature compensation unit may output the second data in the case in which a temperature difference between the respective areas is set to be a predetermined reference value or more. The temperature compensation unit may generate the second data so that the temperatures of each area are similar to each other. Each of the areas may include at least one pixel. In the case in which the first data supplied to a specific pixel are changed into the second data, a light-emitting time of the specific pixel may be changed within the one frame period.

BRIEF DESCRIPTION OF THE DRAWINGS

The accompanying drawings, together with the specification, illustrate exemplary embodiments, and, together with the description, serve to explain the principles of the embodiments.

DETAILED DESCRIPTION

Figure 1:
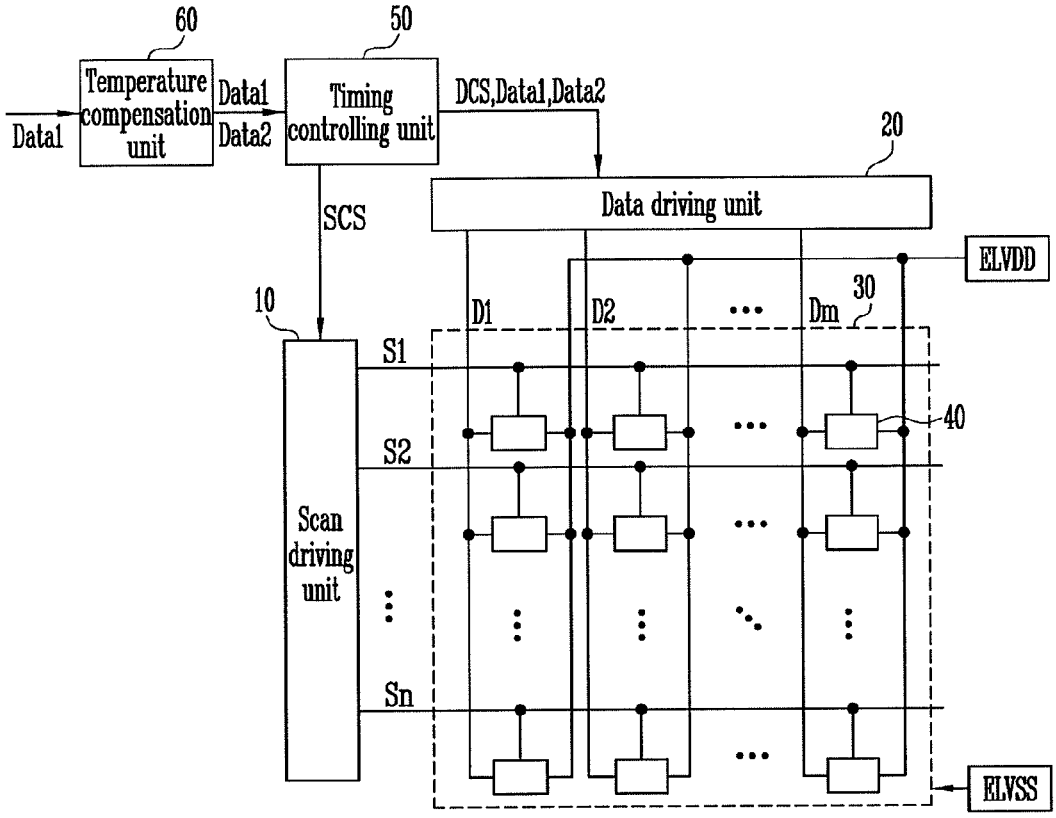
FIG. 1 illustrates a view of an organic light emitting display device according to an exemplary embodiment.
Figure 2:
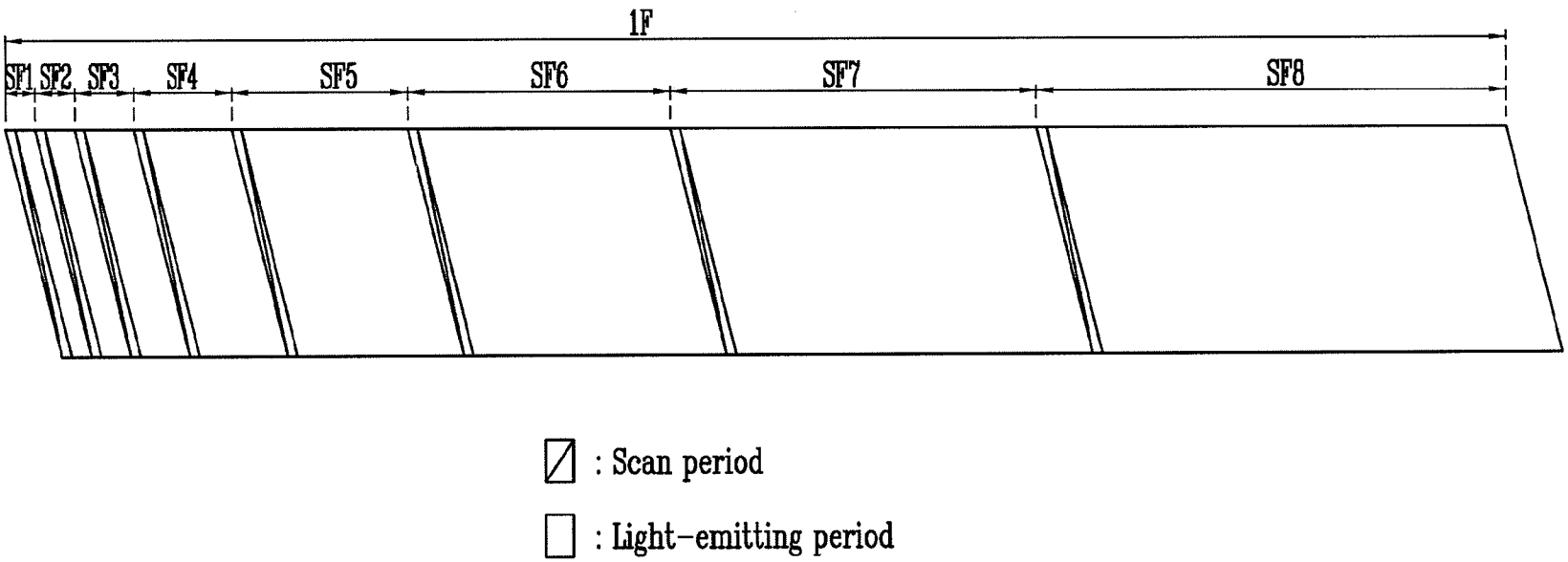
FIG. 2 illustrates a view of one frame period according to the exemplary embodiment.

In the following detailed description, certain exemplary embodiments have been shown and described, simply by way of illustration. As those skilled in the art would realize, the described embodiments may be modified in various different ways, all without departing from the spirit or scope of embodiments. Accordingly, the drawings and description are to be regarded as illustrative in nature and not restrictive. In addition, when an element is referred to as being "on" another element, it can be directly on the another element or be indirectly on the another element with one or more intervening elements interposed therebetween. Also, when an element is referred to as being "connected to" another element, it can be directly connected to the another element or be indirectly connected to the another element with one or more intervening elements interposed therebetween. Hereinafter, like reference numerals refer to like elements.

Hereinafter, exemplary embodiments will be described in detail with reference to FIGS. 1 through 8.

FIG. 1 illustrates a view of an organic light emitting display device according to an exemplary embodiment.

Referring to FIG. 1, the organic light emitting display device according to an exemplary embodiment may be configured to include a pixel unit 30 including a plurality of pixels 40 connected to scan lines S1 to Sn and data lines D1 to Dm, a scan driving unit 10 for driving the scan lines S1 to Sn, a data driving unit 20 for driving the data lines D1 to Dm, and a timing controlling unit 50 for controlling the scan driving unit 10 and the data driving unit 20.

In addition, the organic light emitting display device according to the exemplary embodiment includes a temperature compensation unit 60 that receives a first data Data1 from outside (e.g., outside the temperature compensation unit 60) and supplies the received first data Data1 or a second data Data2 (generated by changing the first data Data1) to the timing controlling unit 50. In an embodiment, the temperature compensation unit 60 may be positioned between the timing controlling unit 50 and the data driving unit 20.

The timing controlling unit 50 generates a data driving control signal DCS and a scan driving control signal SCS corresponding to synchronizing signals supplied from the outside. The data driving control signal DCS and the scan driving control signal SCS generated in the timing controlling unit 50 are supplied to the data driving unit 20 and the scan driving unit 10, respectively. In addition, the timing controlling unit 50 supplies the first and second data Data1 and Data2 supplied from the temperature compensation unit 60 to the data driving unit 20.

The scan driving unit 10 supplies the scan signals to the scan lines S1 to Sn, corresponding to the scan driving control signal SCS. For example, the scan driving unit 10 supplies the scan signals to the scan lines S1 to Sn every scan period of sub frames SF1 to SF8 included in one frame 1F illustrated in FIG. 2. When the scan signals are supplied to the scan lines S1 to Sn, the pixels 40 are selected in a horizontal line unit.

The data driving unit 20 generates data signals using the first data Data1 and/or the second data Data2 supplied thereto corresponding to the data driving control signal DCS. The data driving unit 20 generating the data signals supplies the data signals to the data lines D1 to Dm so as to be synchronized with the scan signals during the scan period of the sub frames SF1 to SF8. In this case, the data signals are supplied to the pixels 40 selected by the scan signals.

Meanwhile, the data driving unit 20 supplies the data signals corresponding to the light-emitting or non-light-emitting of the pixels 40. In this case, the pixel 40 receiving the data signal corresponding to the light-emitting is set in the light-emitting state, and the pixel 40 receiving the data signal corresponding to the non-light-emitting is set to be in the non-light-emitting state during the corresponding sub frame SF period.

The pixel unit 30 includes the pixels 40 disposed at crossed portion of the scan lines S1 to Sn and data lines D1 to Dm. Each pixel 40 receives a first power ELVDD and a second power ELVSS having a voltage lower than the first power ELVDD from the outside. The pixels 40 as described above become the light-emitting state or the non-light-emitting state corresponding to the data signal to implement the grayscale having a predetermined luminance. Meanwhile, according to the exemplary embodiment, a structure of the pixel 40 may be implemented by a suitable circuit.

Figure 3:
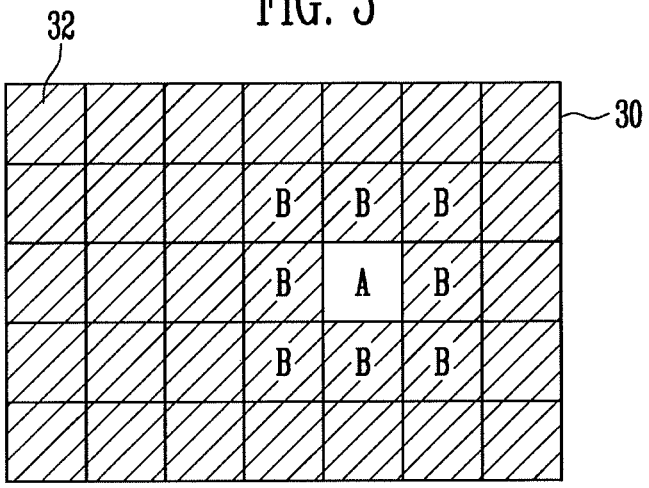
FIG. 3 illustrates a view of an example of a pixel unit divided into a plurality of areas.

The pixel unit 30 includes (e.g., is divided into) a plurality of areas 32 as shown in FIG. 3 and the temperature compensation unit 60 senses the temperature of the divided each area 32. Here, in the case in which the temperature difference for each area 32 is set to be less than the reference value, the temperature compensation unit 60 transfers the first data Data1 to the timing controlling unit 50. In addition, in the case in which the temperature difference for each area 32 is set to have a value equal to or higher than the reference value, the temperature compensation unit 60 generates the second data Data2 by changing the first data Data1, and supplies the generated second data Data2 to the timing controlling unit 50. Here, the second data Data2 is changed to a grayscale value so that the temperature difference for each area 32 has a value smaller than the reference value (a more detailed description thereof will be provided below). Meanwhile, according to the exemplary embodiment, each area 32 includes (e.g., is divided so as to include) at least one of the pixels 40.

Figure 4:
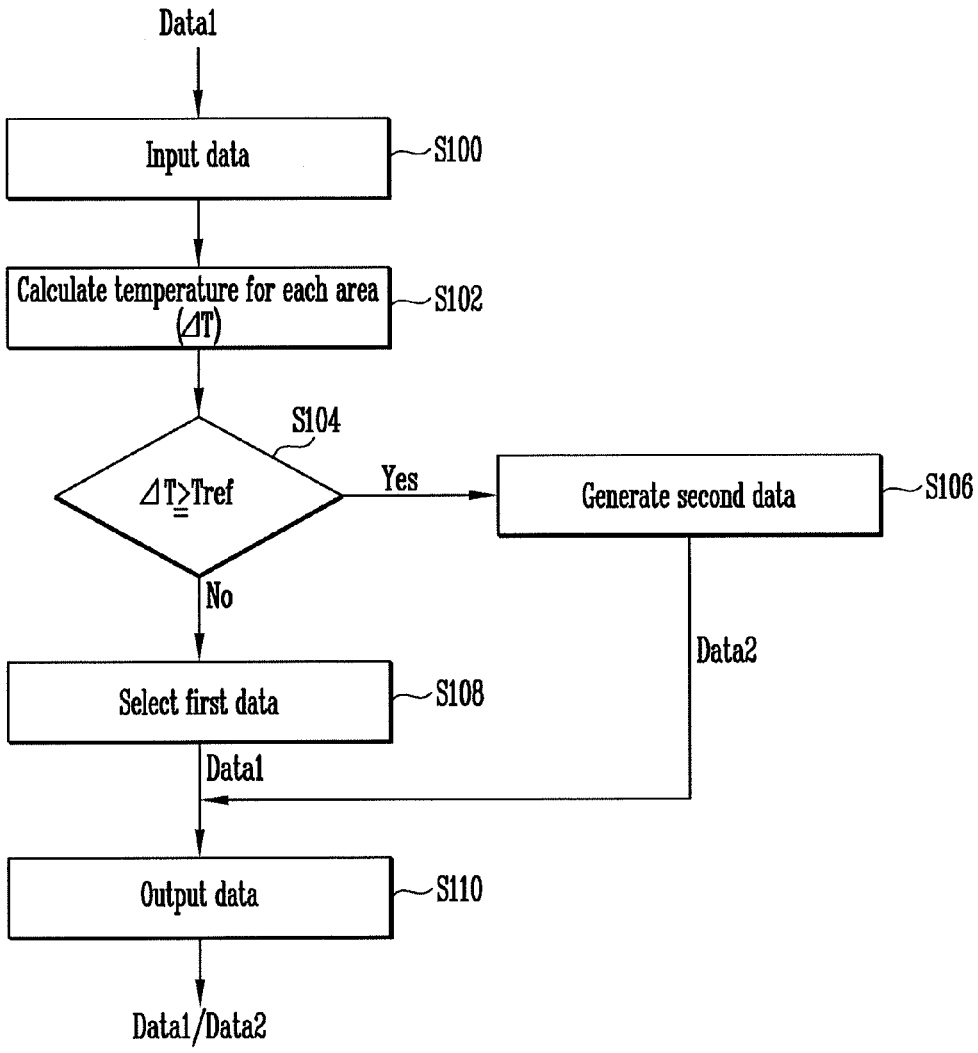
FIG. 4 illustrates a flow chart of an operation process of a temperature compensation unit according to the exemplary embodiment.

FIG. 4 illustrates a flow chart of an operation process of a temperature compensation unit according to the exemplary embodiment.

Referring to FIG. 4, first, the temperature compensation unit 60 according to the exemplary embodiment receives a first data Data1 from outside (S100). Then, in the step (S100), the temperature compensation unit 60 receiving the first data Data1 calculates a temperature of each area 32 using the first data Data1 supplied for each area 32 (S102).

For example, information for light-emitting and non-light-emitting of pixels are included in the first data Data1 supplied to each area 32. That is, information of current flowing in each area 32 is included in the first data Data1. Therefore, the temperature compensation unit 60 may calculate the temperature of each area 32 using the information of the current. As an example, in the step (S102), the temperature of each area 32 may be calculated using the following Equation 1.

$$T=\alpha\times I(x,y)^2R \quad \text{[Equation 1]}$$

In the equation 1, $\alpha$ relates to a constant value reflecting a process deviation, I(x,y) relates to a current value of each area 32 corresponding to the first data Data1, and R relates to a resistance value of each area.

Generally, a predetermined deviation is generated during a process of manufacturing the panel. In this case, even though the same data signals are supplied in each area, the current flowing therein may be changed, corresponding to the process deviation. The $\alpha$, which is the constant value reflecting the process deviation, is set in advance for each of the panels. The R, which is the resistance value of each area 32, includes the resistance of wiring and the resistance of an organic light emitting diode.

Referring to Equation 1, in step (S102), the temperature compensation unit 60 grasps (e.g., extracts) the current I(x,y) of each area using the first data Data1 supplied to each area 32 and then applies the identified current to Equation 1 to calculate the temperature of each area 32. After the temperature is calculated in step (S102), the temperature compensation unit 60 judges whether a temperature difference $\Delta T$ of each area 32 is equal to or higher than a reference value Tref (S104). In the case in which it is judged in step (S104) that the temperature difference $\Delta T$ of each area 32 is smaller than the reference value Tref, the temperature compensation unit 60 transfers the first data Data1 to a timing controlling unit 50 (S108 and S110).

Meanwhile, the reference value Tref is experimentally determined to be a value allowing a luminance deviation by (e.g., resulting from) the temperature difference between the respective areas (e.g., adjacent areas) to be sensed by an observer. In addition, the reference value Tref is experimentally determined so that the original data, that is, the first data Data1, may be output in the case of implementing a general video.

More specifically, in the case of displaying the general video in a pixel unit 30, a predetermined temperature difference may be generated for each area 32. Here, when a separate data (that is, a second data Data2) rather than the original data Data1 is supplied due to the predetermined temperature difference, a desired image may be not displayed. Therefore, according to the exemplary embodiment, in the case of displaying the general video, the reference value Tref is set so that the first data Data1 may be output. As an example, the reference value Tref may be set to 3° C.

When the reference value Tref is set to 3° C., the first data Data1 is output in other images with the exception of the image having an excessive pattern. Meanwhile, the excessive pattern may include a case in which a grayscale in each area 32 disposed adjacent to each other is opposite to each other. For example, the excessive pattern includes a case in which a white is displayed in an area A and a black is displayed in areas B as shown in FIG. 3.

In the case in which it is judged in step S104 that the temperature difference ΔT of each area 32 is equal to or higher than the reference value Tref, the temperature compensation unit 60 changes the first data Data1 to generate the second data Data2 (S106). Here, the temperature compensation unit 60 generates the second data Data2 so that the temperature of each area is similar to each other. The second data Data2 generated in step (S106) is supplied to the timing controlling unit 50 (S110). Meanwhile, since the embodiments is driven in a digital driving scheme, when the first data Data1 supplied to a specific pixel is changed into the second data Data2, the light-emitting time of the specific pixel is changed during one frame period. Then, a generation process of the second data Data2 will be described in greater detail to assume that the white is displayed at the area A and the black is displayed in the areas B as illustrated in FIG. 3.

Figure 5A:
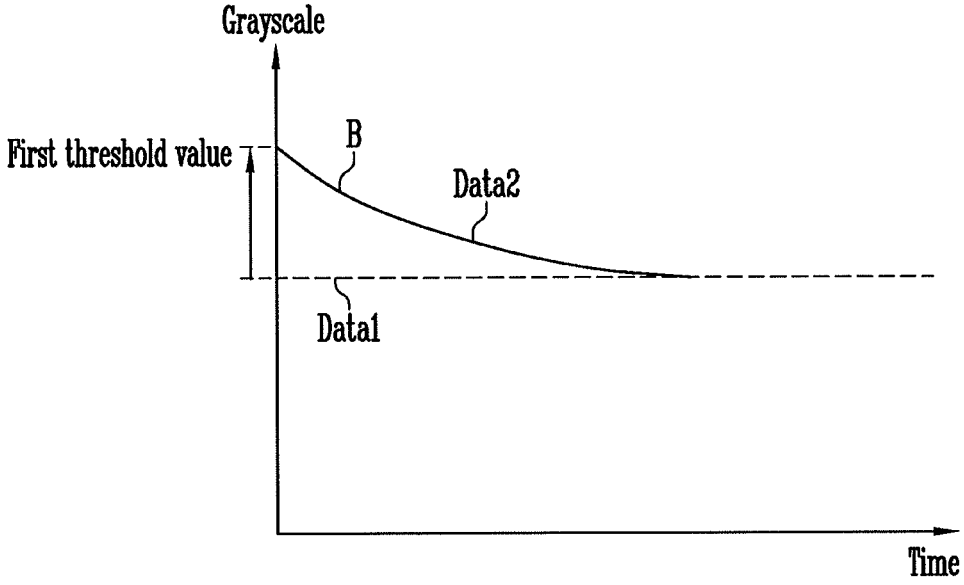
FIGS. 5A and 5B illustrate graphs of an example in which second data are generated.

First, in the case in which the white is displayed in the area A, the temperature of the area A is higher than those of the areas B. In this case, the temperature compensation unit 60 generates the second data Data2 so as to have a grayscale higher than that of the first data Data1 supplied to the areas B by a first threshold value as shown in FIG. 5A so that the temperatures of the areas B may rise. Here, the second data Data2 are supplied during j-th (j indicates 2 or more natural number) frame period and are set so that the grayscale is progressively lowered so as to be the same as that of the first data Data1 from the grayscale that was initially made higher by the first threshold value.

Here, the first threshold value means a maximum grayscale value which may be changed from the grayscale of the first data Data1 and is experimentally determined in order to substantially prevent the luminance deviation from being recognized by eyes of the observer. As an example, the first threshold value may be set to a high grayscale which is as high as 30 grayscale from the grayscale of the first data Data1.

Figure 5B:
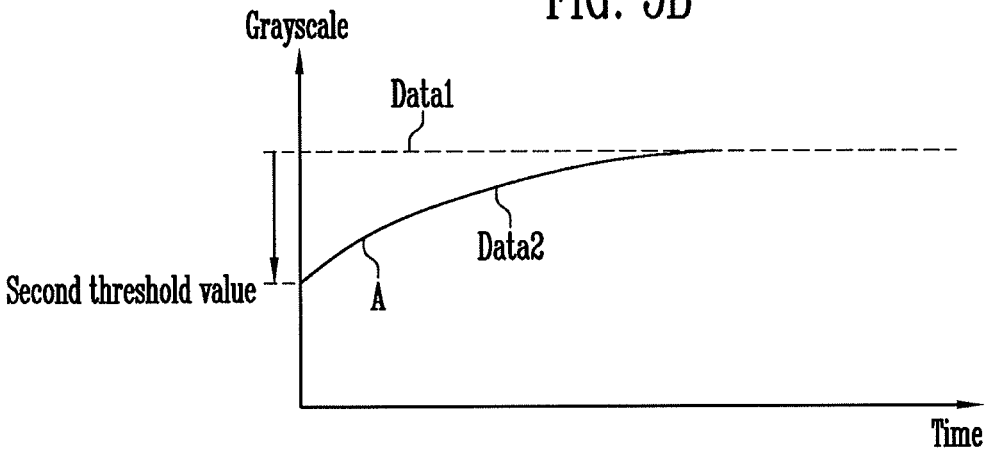

Furthermore, the temperature compensation unit 60 generates the second data Data2 so as to have the grayscale lower than that of the first data Data1 supplied to the area A by a second threshold value so that the temperature of the area A may be lowered as shown in FIG. 5B. Here, the second data Data2 is supplied during the j-th frame period and is set to be progressively increased so as to be the same as the grayscale of the first data Data1 from the grayscale which was initially made lower by the second threshold value.

In addition, the second threshold value means the maximum grayscale value which may be changed from the grayscale of the first data Data1 and is experimentally determined in order to substantially prevent the luminance deviation from being recognized with eyes of the observer. As an example, the second threshold value may be set to have the same grayscale of the first threshold value.

As described above, according to the exemplary embodiment, in the case in which the temperature of the area A is set to have the temperature difference more than the reference value Tref compared to the adjacent areas B, the grayscale of the data supplied to the area A and areas B during at least two frame periods is changed. In that case, since the luminance is changed in the area A and the areas B adjacent to the area A, that is, a wide area, the luminance deviation recognized by the observer may be minimized. Additionally, in the case in which the pattern as shown in FIG. 3 is input during the predetermined period, the temperature compensation unit 60 output the second data Data2 during the predetermined period to maintain the minimum temperature difference between the area A and the areas B. In addition, after the predetermined period, the temperature compensation unit 60 output the first data Data1 in the case in which the general pattern is input rather than the pattern as shown in FIG. 3. Here, since the minimum temperature different between the area A and areas B is maintained during the predetermined period, the image may be stably implemented the image corresponding to the first data Data1 after the predetermined period. For example, as illustrated in FIGS. 5A and 5B, the grayscale of area A and areas B may be slowly changed (gradually changed) in a non-linear manner.

Figure 6A:
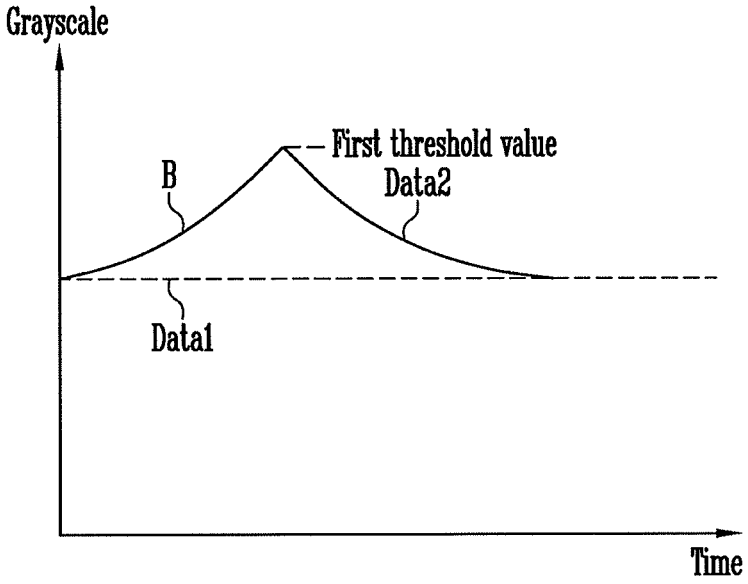
FIGS. 6A and 6B illustrate graphs of another example in which second data are generated.
Figure 6B:
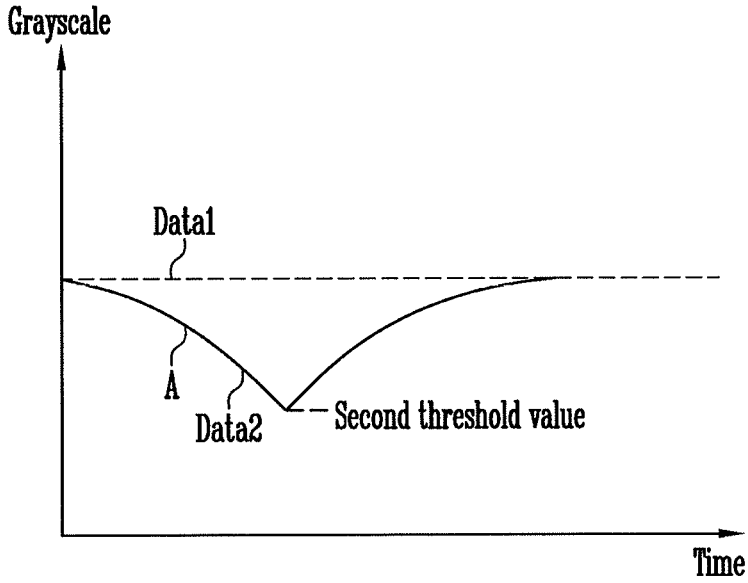

FIGS. 6A and 6B illustrate graphs of another example in which the second data is generated.

Referring to FIGS. 6A and 6B, the temperature compensation unit 60 may generate the second data Data2 which slowly increases from the grayscale of the first data Data1 toward the grayscale which is as high as the first threshold value and then slowly decreases from the grayscale which is as high as the first threshold value toward the grayscale of the first data Data1 so that a temperature of areas B may be increased. In addition, the temperature compensation unit 60 may generate the second data Data2 which slowly decreases from the grayscale of the first data Data1 toward the grayscale which is as low as the second threshold value and then slowly increases from the grayscale which is as low as the second threshold value toward the grayscale of the first data Data1 so that a temperature of areas A may be decreased. When the second data Data2 is generated to be slowly increased and decreased (or decrease and increase) from the grayscale of the first data Data1 as described above, the luminance difference recognized by the observer may be minimized.

Figure 7A:
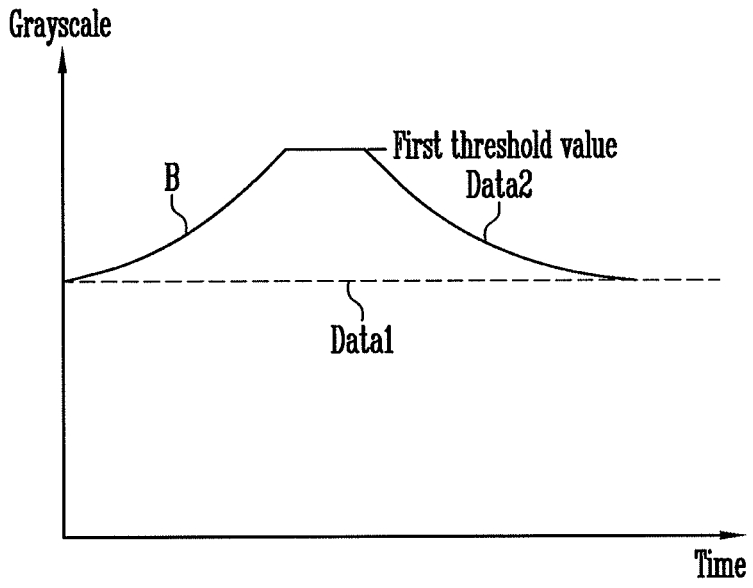
FIGS. 7A and 7B illustrate graphs of still another example in which second data are generated.
Figure 7B:
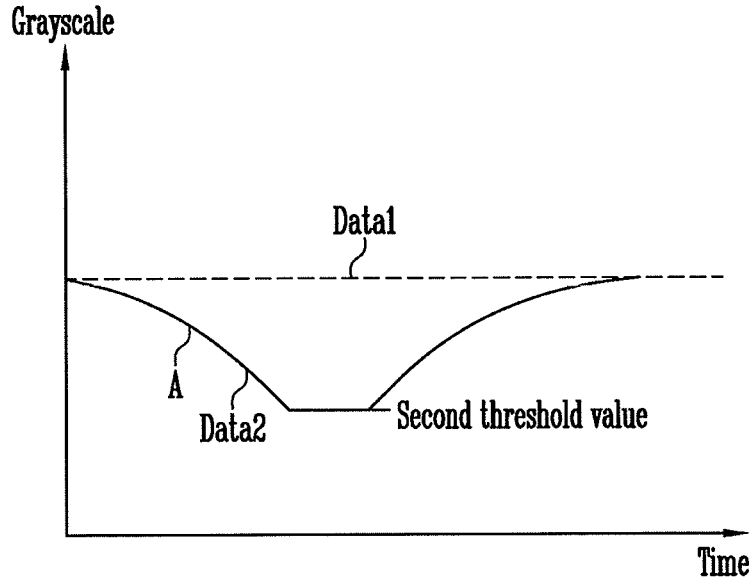

FIGS. 7A and 7B illustrate graphs of still another example in which the second data is generated.

Referring to FIGS. 7A and 7B, the temperature compensation unit 60 may generate the second data Data2 which slowly increases from the grayscale of the first data Data1 toward the grayscale which is as high as the first threshold value and then slowly decreases from the grayscale which is as high as the first threshold value toward the grayscale of the first data Data1 so that a temperature of areas B may be increased. Here, the second data Data2 maintains the grayscale which is as high as the first threshold value during the predetermined period (at least one frame period), therefore the temperature of the areas B may be stably increased.

In addition, the temperature compensation unit 60 may generate the second data Data2 which slowly decreases from the grayscale of the first data Data1 toward the grayscale which is as low as the second threshold value and then slowly increases from the grayscale which is as low as the second threshold value toward the grayscale of the first data Data1 so that a temperature of areas A may be decreased. Here, the second data Data2 maintains the grayscale which is as low as the second threshold value during the predetermined period (at least one frame period), therefore the temperature of the area A may be stably decreased.

Figure 8:
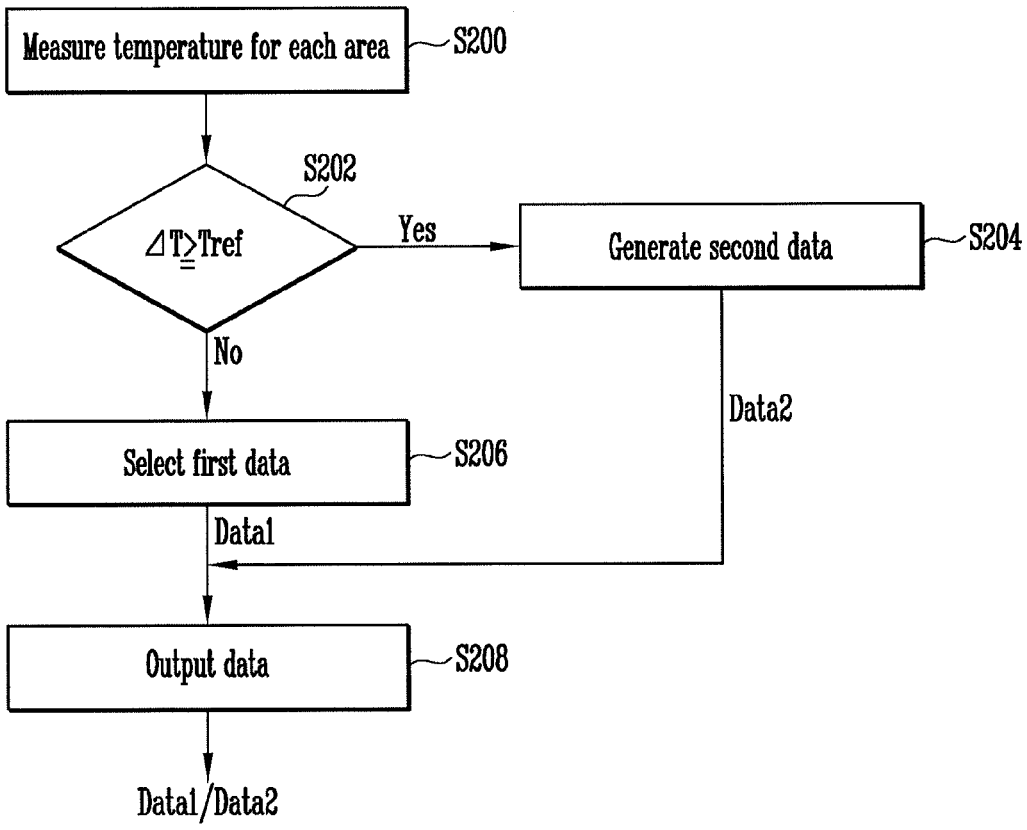
FIG. 8 illustrates a flow chart of an operation process of a temperature compensation unit according to another exemplary embodiment.

FIG. 8 illustrates a flow chart of an operation process of a temperature compensation unit according to another exemplary embodiment. In FIG. 8, a temperature of each area 32 is measured by using a temperature sensor and has the same driving process similar to those of FIG. 4.

Referring to FIG. 8, a temperature compensation unit according to the exemplary embodiment measures the temperature of each area 32 using the temperature sensor formed for each area 32 (S200). After the temperature is measured in step (S200), the temperature compensation unit 60 judges whether a temperature difference ΔT of each area 32 is equal to or higher than a reference value Tref (S202). In the case in which it is judged in step (S202) that the temperature difference ΔT of each area 32 is smaller than the reference value Tref, the temperature compensation unit 60 transfers a first data Data1 to a timing controlling unit 50 (S206 and S208).

In the case in which it is judged in step (S202) that the temperature difference ΔT of each area 32 is equal to or higher than the reference value Tref, the temperature compensation unit 60 changes a first data Data1 to generate a second data Data2 (S204). Here, a generating method of the second data Data2 is the same as those of FIG. 4 as described above. Therefore, a detailed description thereof will be not be repeated. The second data Data2 generated in step (S204) is supplied to the timing controlling unit 50 (S208). Actually, the temperature compensation unit 60 according to another exemplary embodiment measures the temperature of each area 32 using the temperature sensor and controls the driving of the device so that the temperature difference ΔT of each area 32 is smaller than the reference value Tref, corresponding to the measured temperature.

By way of summary and review, an organic light emitting diode device may include a plurality of pixels arranged in a matrix form with the pixels being in portions at which a plurality of data lines and scan lines intersect with each other. The pixels may be configured to include the organic light emitting diode, at least two transistors including a driving transistor, and at least one capacitor. The organic light emitting diode device may be driven in an analog driving scheme or a digital driving scheme. The analog driving scheme may implement a grayscale by controlling an amount of current supplied into the organic light emitting diode corresponding to the data signal. In this case, the driving transistor is driven as a constant current source corresponding to the data signal.

The digital driving scheme may implement the grayscale by controlling a light-emitting and a non-light-emitting state of the pixels corresponding to the data signal. In other words, in the digital driving scheme, the grayscale may be implemented by using the light-emitting time of the pixels. In this case, the driving transistor may be driven at a constant voltage source in order to control the time of the light-emitting and the non-light-emitting states of the organic light emitting diode.

However, in the case in which the driving transistor is driven as the constant voltage, luminance of the pixels may change corresponding to temperature. That is, in the digital driving scheme, the current may be sensitively changed according to the temperature. Therefore, a luminance deviation may occur according to the temperature in the case of implementing an image of a specific pattern.

With the organic light emitting diode display and the driving method thereof according to the embodiments, the temperature for each area of the panel is extracted and the data are controlled so that the luminance deviation due to the temperature is mitigated (i.e., such that observance of the luminance deviation by the user is reduced and/or substantially prevented). In order words, according to the embodiments, the data is controlled so that the temperature difference between each area of the panel is set to be less than the reference value, thereby making it possible to improve display quality.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A driving method of an organic light emitting display device, the method comprising:

sensing temperatures of a plurality of areas included in a pixel unit;

when a temperature difference between the respective areas is less than a predetermined reference value, outputting first data that is input from outside;

when the temperature difference between the respective areas is equal to or greater than the reference value, generating second data by changing a grayscale of the first data such that the temperatures of the respective areas are similar to each other, and outputting the second data.

2. The method as claimed in claim 1, wherein each of the areas includes at least one pixel.

3. The method as claimed in claim 1, wherein sensing the temperatures includes:

inputting the first data;

extracting a current flowing in each area using the first data; and calculating the temperatures of each area by using the extracted current, a process deviation, and a resistance value of each area.

4. The method as claimed in claim 1, wherein sensing the temperatures includes sensing the temperatures of each area using temperature sensors installed in each area.

5. The method as claimed in claim 1, wherein generating the second data includes setting a grayscale of the second data such that the grayscale of the second data is different from that of the first data by a predetermined threshold value.

6. The method as claimed in claim 5, wherein generating the second data includes gradually changing the grayscale of the second data from a grayscale higher or lower than the grayscale of the first data by the threshold value to the grayscale of the first data.

7. The method as claimed in claim 6, wherein generating the second data includes gradually changing the grayscale of the second data from the grayscale of the first data to the grayscale higher or lower than the grayscale of the first data by the threshold value.

8. The method as claimed in claim 7, wherein the second data maintain the grayscale higher or lower than the grayscale of the first data by the threshold value during at least one frame period.

9. The method as claimed in claim 1, wherein, when the first data supplied to a specific pixel is changed into the second data, a light-emitting time of the specific pixel is changed within one frame period.

10. An organic light emitting diode display, comprising:

a pixel unit including pixels at portions at which scan lines and data lines intersect with each other; and a temperature compensation unit, the temperature compensation unit outputting first data or second data according to temperatures of a plurality of areas included in the pixel unit, the first data being input from outside, and the second data being generated by changing a grayscale of the first data, wherein the temperature compensation unit outputs the second data when a temperature difference between the respective areas is equal to or greater than a predetermined reference value.

11. The organic light emitting diode display as claimed in claim 10, wherein the temperature compensation unit generates the second data such that the temperatures of each area are similar to each other.

12. The organic light emitting diode display as claimed in claim 10, wherein each of the areas includes at least one pixel.

13. The organic light emitting diode display as claimed in claim 10, wherein, when the first data supplied to a specific pixel is changed into the second data, a light-emitting time of the specific pixel is changed within one frame period.

14. A driving method of an organic light emitting display device including a pixel unit having a first area and a second area, the method comprising:

inputting first data from outside, the first data including first area data for the first area and second area data for the second area;

sensing temperatures of the first area and the second area of the pixel unit;

comparing the temperature of the first area with the temperature of the second area;

when a temperature difference between the first and second areas is less than a predetermined reference value, outputting the first area data and the second area data to be displayed in the pixel unit;

when the temperature difference between the first and second areas is equal to or greater than the predetermined reference value, generating second data including modified first area data and modified second area data, the modified first area data and the modified second area data generated by changing grayscales of the first area data and the second area data, respectively, such that the temperatures of the first and second areas are similar to each other, and outputting the modified first area data and the modified second data to be displayed in the pixel unit instead of the first area data and the second area data, respectively.

15. The method as claimed in claim 14, wherein when the temperature of the first area is higher than that of the second area by the predetermined reference value, the modified first area data is generated by decreasing the grayscale of the first area data, and the modified second area data is generated by increasing the grayscale of the second area data.

16. The method as claimed in claim 14, wherein the predetermined reference value is determined to be a value allowing a luminance deviation by the temperature difference between the first and second areas to be sensed by an observer.

17. The method as claimed in claim 14, wherein:

after the modified first area data and the modified second area data are displayed in the pixel unit, the modified first area data and the modified second area data are gradually changed during a predetermined period such that the modified first area data and the modified second area data are same as the first area data and the second area data, respectively.

18. The method as claimed in claim 14, wherein the first area and the second area are adjacent to each other.

* * * * *